United States Patent [19]

Corn

[11] Patent Number: 4,735,415

[45] Date of Patent: Apr. 5, 1988

[54] BASEBALL GAME

[75] Inventor: Ray A. Corn, Dickinson, Tex.

[73] Assignee: Charles Herbeck, Texas City, Tex.

[21] Appl. No.: 918,691

[22] Filed: Oct. 16, 1986

Related U.S. Application Data

[63] Continuation of Ser. No. 763,048, Aug. 6, 1985, abandoned.

[51] Int. Cl.[4] ..... A63F 7/20

[52] U.S. Cl. ..... 273/89

[58] Field of Search ..... 273/90, 89, 93 R, 120 R, 273/120 A

[56] References Cited

U.S. PATENT DOCUMENTS

| | | | |
|---|---|---|---|
| 861,841 | 7/1907 | Heitmann | 273/89 |
| 951,257 | 3/1910 | Peuser | 273/89 |
| 1,122,141 | 12/1914 | McIlroy | 273/89 |
| 1,235,119 | 7/1917 | Day | 273/89 |
| 1,266,271 | 5/1918 | Hunt | 273/120 R |
| 1,296,882 | 3/1919 | Vance | 273/89 |
| 1,532,708 | 4/1925 | Moore | 273/89 |
| 1,571,469 | 2/1926 | Fredette | 273/89 |
| 1,573,182 | 2/1926 | Matha | 273/89 |
| 1,623,038 | 4/1927 | Babbit | 273/89 |
| 2,251,724 | 8/1941 | Vogel | 273/90 |
| 2,412,714 | 12/1946 | Caesar | 273/90 |
| 2,417,641 | 3/1947 | Fischer | 273/120 R X |
| 2,462,170 | 2/1949 | Dube | 273/90 |
| 2,775,457 | 12/1956 | Galbos | 273/90 |
| 2,980,427 | 4/1961 | Gragg | 273/90 |
| 3,009,452 | 11/1961 | Barber et al. | 273/89 X |
| 3,101,197 | 8/1963 | Schultz | 273/89 |
| 3,709,494 | 1/1973 | Barlow | 273/89 |
| 3,781,012 | 12/1973 | Slane | 273/90 X |

FOREIGN PATENT DOCUMENTS

| | | | |
|---|---|---|---|
| 2364058 | 12/1973 | Fed. Rep. of Germany | 273/120 A |
| 19378 | 9/1902 | United Kingdom | 273/120 R |

*Primary Examiner*—Paul E. Shapiro

*Attorney, Agent, or Firm*—Browning, Bushman, Zamecki & Anderson

[57] ABSTRACT

A baseball simulation game, in which two opponents actively participate to have a decisive effect on results of play, has a stadium defining a playing surface upon which is described a baseball diamond. Nine defensive player figures are movably positioned on the playing surface, each figure being formed to interrupt the flight of a ball. A tube extends from outside the stadium above centerfield down to a point above and between a pitcher's mound and home plate so that balls dropped in the upper end by the defensive opponent will fall from the lower end in a ballistic curve through a strike zone at home plate. The stadium provides controlled access for the offensive opponent to extend one hand over home plate to strike at balls with a scale bat, using wrist motion only. Play follows the rules of baseball with rolls of dice determining the outcome of action which cannot be simulated.

33 Claims, 3 Drawing Sheets

BASEBALL GAME

This is a continuation of co-pending application Ser. No. 763,048 filed on Aug. 6, 1985 now abandoned.

BACKGROUND OF THE INVENTION

1. Field of the Invention

The present invention relates to a game which simulates in minature, the action of a full-scale outdoor baseball game.

2. Description of the Prior Art

The sport of baseball has long been considered the national sport of the United States and is avidly followed by millions of fans throughout the year from spring training to the climactic world series in the fall. There is even the so-called "hot stove" league which argues, trades, plays and transactions throughout the few winter months when baseball is not actively being played. There have been attempts made to provide baseball substitutes for these millions of fans in the form of games which are played with cards, dice and boards and even electronics in the form of both hand-held and TV screen/computer displays. All of these prior attempts have had the major drawback of providing only very limited participation by the players. With the card and dice-type games, there is very little skill that can be applied by the player. In the computerized electronic games, there is also little opportunity for the player to demonstrate skill as many of the actions are only initiated by the player and are completed by the computer. For example, in one well known electronic hand-held baseball game, the player initiates a pitch by pushing a button and then "swings" by pushing another button. The timing and style of the pitch are strictly under the control of the computer as are the results of the swing. Such an arrangement can provide only limited satisfaction for the player and only short-term interest as the skill level of the player rapidly exceeds that provided by the electronics. The present invention overcomes many of the drawbacks of the prior art by providing a baseball simulation game in which the results are directly related to the competitive skills of two opponents.

SUMMARY OF THE INVENTION

The present invention allows two opponents to actively participate in simulating play of a game of baseball and includes a scale stadium describing a baseball diamond playing surface and nine defensive player figures which can be movably positioned on the playing surface. An inclined tube is fixedly mounted from over centerfield to a position near and above the pitcher's mound through which a ball, such as a marble, is dropped by the defensive opponent to fall in a ballistic curve through a strike zone at home plate. The offensive opponent extends a hand through a limited access opening adjacent home plate and is provided with a miniature bat with which the strike at the ball with wrist action only. The results of the swing are immediately apparent by the fight of the ball. The rules for playing the game follow those of an actual baseball game with accommodations for the fact that it is miniature in scale and the defensive players remain immobile during individual plays. The results of action which cannot be simulated are determined by a roll of dice.

BRIEF DESCRIPTION OF THE DRAWINGS

An example of the present invention will now be described by way of example with reference to the accompanying drawings in which.

DESCRIPTION OF THE PREFERRED EMBODIMENT

Figure 1:
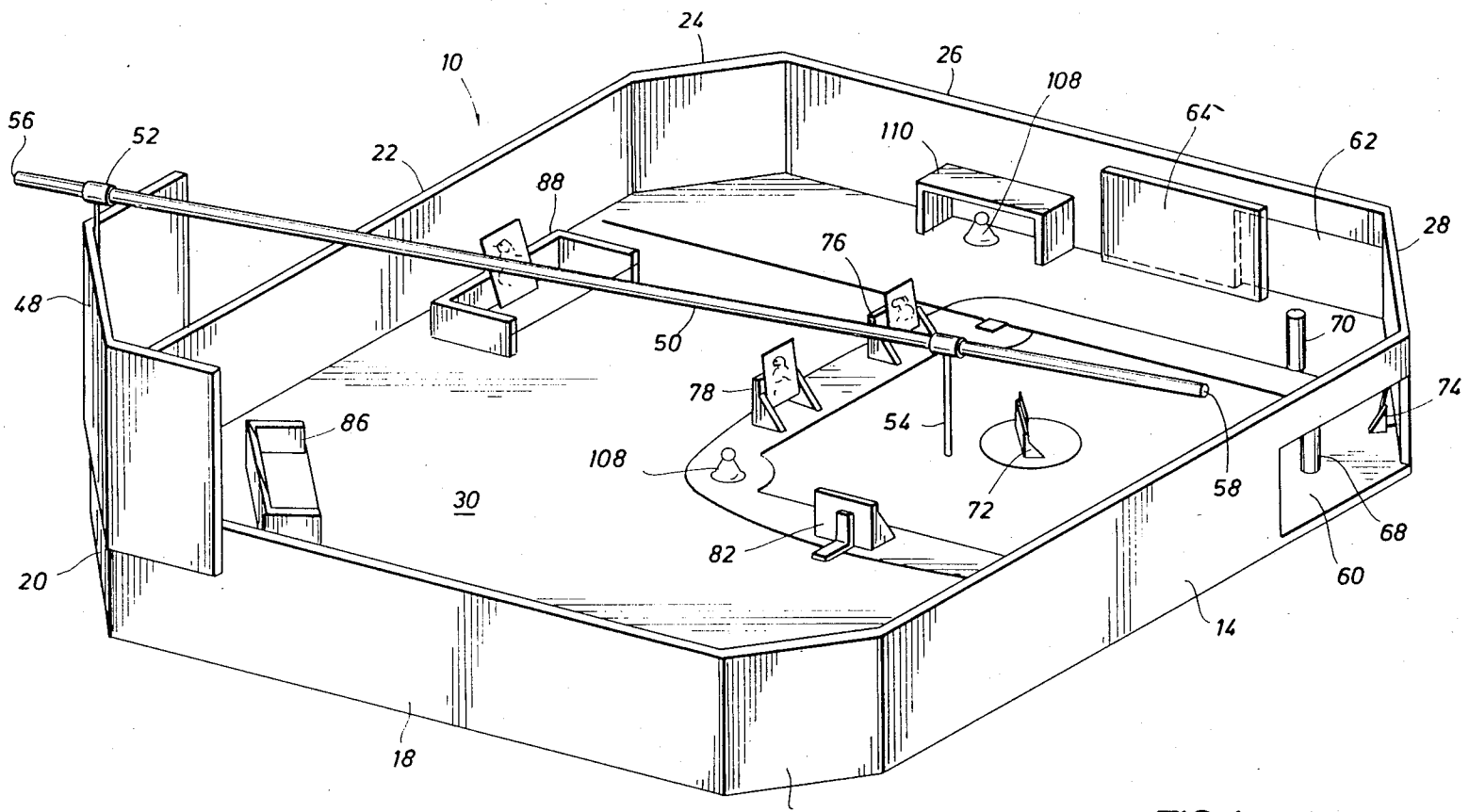
FIG. 1 is a perspective view of a stadium in accordance with the present invention.
Figure 2:
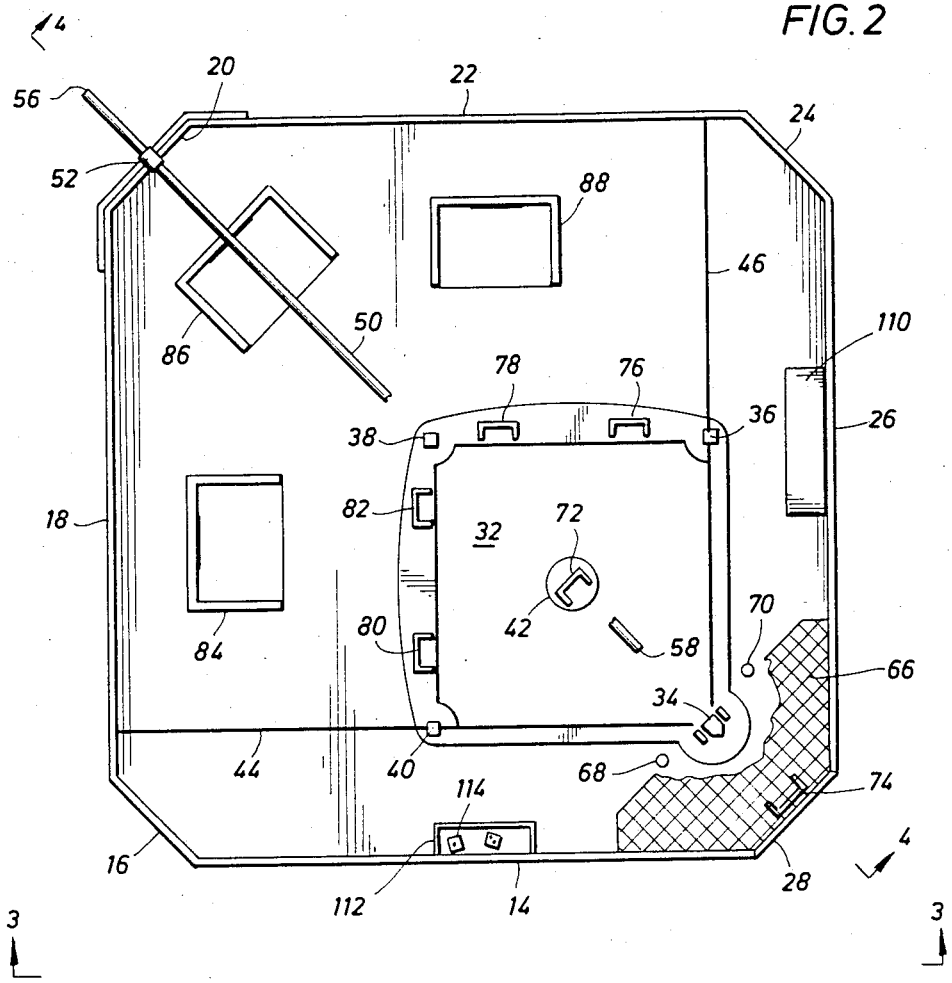
FIG. 2 is a top plan view of the stadium of FIG. 1.
Figure 3:
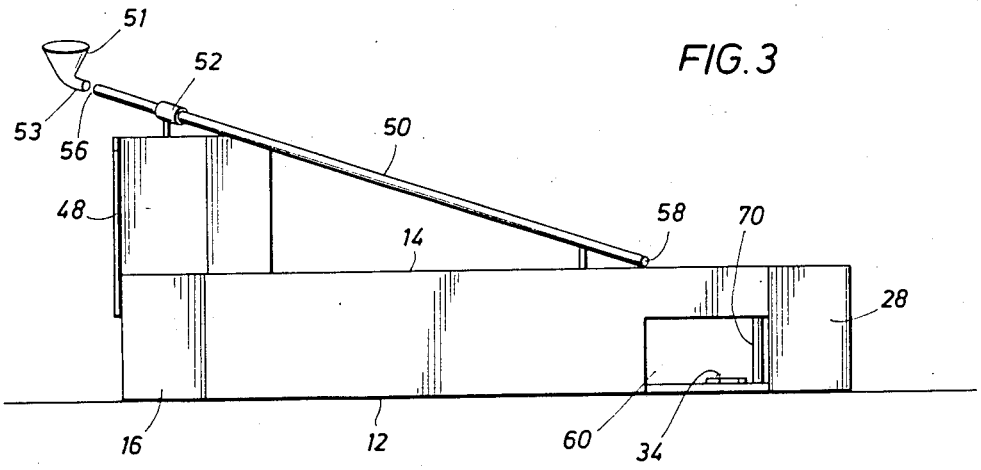
FIG. 3 is a side elevation of the stadium taken along line 3—3 of FIG. 2.
Figure 4:
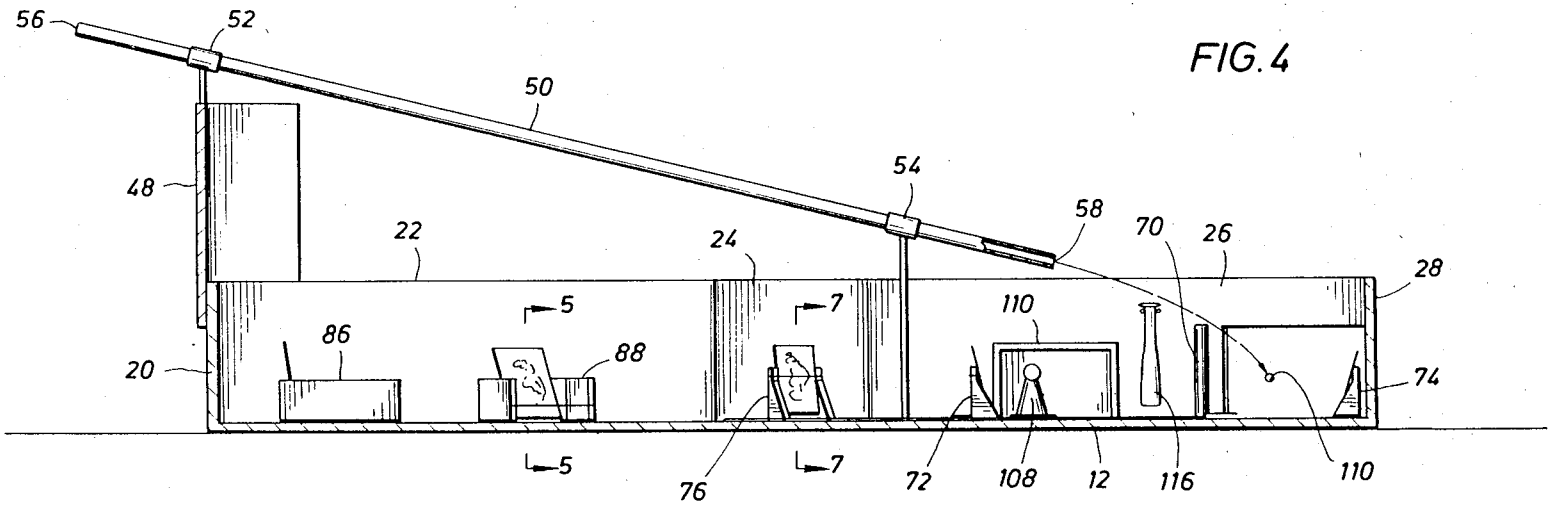
FIG. 4 is a vertical section through the stadium taken along line 4—4 of FIG. 2.

The subject baseball game is played in a stadium 10 which is shown with a geometrically regular shaped configuration. It is to be understood that this configuration is merely representative and that any well known baseball stadium of past, present or future reknown could be used to stylize the stadium 10. For example, famous, and now gone, stadiums such as the Polo-grounds or Ebbitt's Field could be used, as well as a present indoor stadium, such as the Astrodome, or outdoor stadium, such as Wrigley Field. This does not prohibit forming the stadium into a completely idealistic and possibly futuristic configuration. The stadium includes a large rigid, preferably seamless bottom board member 12 enclosed on all sides by walls 14, 16, 18, 20, 22, 24, 26, 28 all rigidly fixed to each other and to peripheral portions of the member 12. The surface of the member 12 surrounded by the walls forms a playing surface 30 which is preferably convered by a felt-like material or other similarly textured material having a slight degree of resiliency. The playing surface 30 is also provided with a conventional baseball diamond design, as best seen in FIG. 2, and includes an infield 32 with home plate 34, first base 36, second base 38, third base 40, pitcher's mound 42 and foul lines 44, 46. Attached to the walls 18, 20, 22, which define the centerfield area, is a score board 48. An opaque, continuous tube 50 having a first diameter bore is fixedly positioned by a bracket 52 at the top of the score board 48 and a bracket 54 in the infield. It will be appreciated, most particularly from FIG. 4, that a first end 56 of this tube extends above and beyond the score board 48 and that a second end 58 is spaced above the playing surface 30 in a position aligned between the pitcher's mound 42 and the home plate 34. It is important that this tube be opaque so that the offensive opponent cannot see the ball too soon and accordingly time his swing. The first end of the tube 56 can be cut normal to the axis of the tube, as shown, or can be profiled, such as being flared outwardly to form a conical entry (not shown) or the first end could be curved upwardly from the axis of the tube (also not shown). A funnel-shaped member 51 with a straight, curved, or flexible spout 53 can also be provided for attachment to the first end 56 of tube 50 to control the manner in which the ball is delivered to the tube 50. Batter access ports 60, 62 are provided in the side walls 14, 26, respectively, on either side of the home plate 34, and normally one port is closed by a removable cover 64. The area immediately above and behind the home plate is preferably covered by a protective screen 66 (shown only in FIG. 2 for convenience) and offensive opponent swing limiting posts 68, 70 are fixedly attached to the member 12 equally spaced on opposite sides of the home plate 34.

Figure 8:
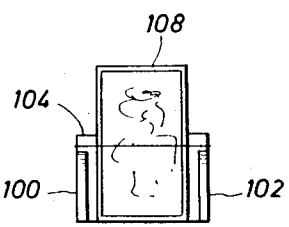
FIG. 8 is a front elevation of the infield player piece taken along line 8—8 of FIG. 7.
Figure 7:
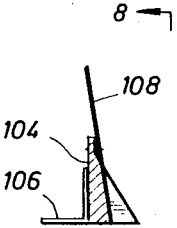
FIG. 7 is a vertical section through an infield player piece taken along line 7—7 of FIG. 4.
Figure 6:
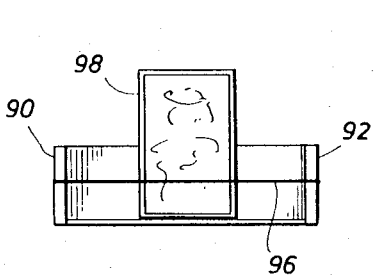
FIG. 6 is a front elevation of the outfield player piece taken along line 6—6 of FIG. 5.
Figure 5:
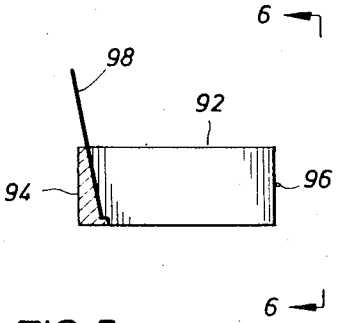
FIG. 5 is a vertical section through an outfield player piece taken along the line 5—5 of FIG. 4.

The subject game is provided with nine defensive player pieces 72, 74, 76, 78, 80, 82, 84, 86, 88 which are shown positioned for a pitcher, catcher, first, second and third basemen, shortstop, left field, center field and right field, respectively. The defensive player pieces are in two styles with those for the infield being smaller than those for the outfield. The details of the player pieces will be described with reference to FIGS. 5–8. FIGS. 5 and 6 show an outfield player piece. Each of the three outfield player pieces 84, 86, 88 is formed with spaced side walls 90, 92 joined integrally with a rear wall 94. The walls form a generally rectangular shape with one side open. On the open side there is a string or like resilient thin member 96 stretched between the free ends of the side walls 90 and 92 and spaced above the playing surface 30. The outfield player piece can be completed by the optional addition of a two or three-dimensional figure, such as a card 98, bearing the likeness of a baseball player. The infield player pieces, FIGS. 7 and 8, are similar to the outfield player pieces in that they have side walls 100, 102 fixed to and extending from opposite ends of a rear wall 104. A brace 106 extends fixedly rearwardly from the wall 104 at the playing surface to help in stabilizing the infield player piece. The infield player piece can also be completed by the addition of a FIG. 108. It should be noted in comparing the player pieces that the side walls 90 and 92 of the outfield player pieces are rectangular in shape while the side walls 100, 102 of the infield player pieces are triangular in shape, substantially smaller, and more closely spaced. Since, during play of the game, all player pieces are substantially immobile, the size of the outfield pieces is scaled to be representative of the area which can be covered by a live baseball player. Since the ball takes longer to get to the outfield, the normal outfielder clearly can cover a greater distance than an infielder. The purpose of the string on the outfield player pieces is to distinguish between a ball that would have been caught on the fly and a ball that would have been caught after touching the ground, considering the different rules which would apply for a runner in the two situations.

The subject game is also provided with three offensive or runner player pieces 108, which can be either peg-like figures, as shown, or more graphic representations of baseball players in running or other action poses.

The stadium is further provided with a dugout 110, a dice box 112 and dice 114. The dugout and dice box can be fixed or movable as desired. The stadium can also be provided with means to hold bats 116.

In a representative embodiment, the stadium 10 has a hexagon shape four feet across providing approximately 14 square feet of playing surface. The member 12 preferably is made of something substantial, such as ¾" plywood, while the side walls are made of ¾"×7¼" wood. The playing surface is preferably covered with contrasting colored felt to simulate the grass and the bare shaped dirt areas of a conventional baseball diamond. The tube 50 preferably has a ¾" inner diameter and the balls are white marbles 110 of approximately ½" diameter. The bats 116 are ½" long pieces of shaped ½" dowel to maintain scale with the balls.

The game is played by the defensive opponent positioning the defensive player pieces in any manner he sees fit, limited, of course, by the pitcher on the mound, the catcher behind the plate, the infielders no further in than the infield grass nor outside the foul lines nor further back than touching the outfield grass, and the shortstop and second baseman cannot cross to the opposite sides of second base relative their respective positions. Play is initiated by the offensive opponent extending a hand through one of the ports 60, 62 and holding a bat. Movement of the offensive opponent's hand is restricted by the posts 68, 70 and the screen 66, which also protects the offensive opponent from "pop up" balls. The offensive opponent is limited to only wrist motion in striking at the ball. A pitch is initiated by the defensive opponent dropping a ball 110 into the first end 56 of the tube 50. The ball rolls down the tube by gravity and drops from the end 58 following a ballistic trajectory which will cause it to pass across home plate 34. The offensive opponent has the choice of swinging at the ball or not as it is delivered. If he swings and misses, that is of course a strike. If he chooses not to swing, he then rolls dice with an odd number being a "called" strike and an even number being a "called" ball. If the offensive opponent hits the ball and the ball in turn hits any infield playing piece, this is an out. If the ball goes on the fly into an area defined by the side walls and rear wall of an outfield player piece, this is an out. If a ball rolls under the string of an outfield player piece, then this also is an out but provides the opportunity for a runner on base to advance. Should there be a base runner and opportunity for the runner to advance, then there is a roll of the dice with an odd number being an out and an even number a safe advance by the runner. If there is a base runner and the ball strikes an infield player piece, then there is a roll of the dice with an even number being a double play and an odd number calling the lead runner out (fielder's choice). Balls striking walls 18 and 22 on the fly are considered doubles; balls hitting wall 20 on the fly are considered triples, balls going over walls 18, 20, 22, within the foul lines are, of course, home runs. Balls striking the tube 50 or brackets 52, 54 are outs. If the offensive opponent wishes to attempt a steal, this is done by rolling the dice with a 1, 7 or 11 a completed steal, any other number being an out. Play can be on the basis of a 7 or a 9 inning game, each side having three outs per inning.

With the present invention, it is entirely possible to simulate the action of a real baseball game with the opponents being actively involved in the action and with their reactions definitely affecting the results. The stadium can be formed to any configuration and the size and shape discussed above are purely representative. The player pieces can be made more realistic, as described above, by the addition of cards and/or two or three-dimensional figures which can be merely representative of baseball players or likenesses of actual individuals so that an ideal, all time, or all star team can be assembled in accordance with the whims of the opponents.

No details have been shown for the scoreboard 48 because of the wide range of possible configurations available from the known art. These include simple hooks from which numeral bearing cards are suspended, similar to those found in Little League stadiums, to electronic devices, such as those found in major league stadiums with graphic displays. Chalk boards or other means to keep a running record of the progress of the game would also be included.

While the means for delivering the ball has been shown and described as a tube, clearly other shapes, including open channels and linear and curved configurations could be used.

What is claimed is:

1. A baseball simulation game allowing at least two active participants to control the play and comprising:

a stadium formed by a member defining a playing surface with a baseball diamond described thereon, and fixed walls enclosing said member on all sides thereof, said playing surface being substantially free of any impediment to movement of a ball thereacross;

a pair of entry ports in said walls each spaced to opposite sides of said diamond allowing restricted access to home plate;

an opaque, continuous, open-ended elongate tube having a bore of a first diameter;

means fixedly mounting said tube on an incline so as to provide access to an entry end outside and above the stadium with the opposite exit end spaced above and in front of home plate on a line between a pitcher's mound and home plate;

at least one ball of a second diameter smaller than said first diameter of said tube;

at least one bat of a diameter and length proportional to said ball;

three offensive player pieces; and nine defensive player pieces each having a backwall and a pair of spaced forwardly directed integral side walls forming an open-sided rectangle, whereby one participant positions the defensive player pieces and delivers a ball to the tube and the other participant bats at the ball and moves the offensive player pieces to simulate play of an actual baseball game.

2. A game according to claim 1 wherein each said defensive player piece further comprises means to support a player figure thereon.

3. A game according to claim 2 wherein said player figure is tow-dimensional.

4. A game according to claim 2 wherein said figure is three-dimensional.

5. A game according to claim 1 wherein three of said defensive player pieces for outfield positions have side walls spaced further apart than for the remaining six defensive player pieces for infield positions.

6. A game according to claim 5 wherein each of the three defensive player pieces for the outfield positions have a resilient band spanning the free ends of said side walls and spaced from said playing surface, whereby "fly" balls and "ground" balls are distinguished.

7. A game according to claim 1 wherein said tube is metal.

8. A game according to claim 1 wherein said tube is opaque.

9. A game according to claim 1 wherein said tube is open only at said entry and exit ends.

10. A game according to claim 1 wherein said entry end of said tube is flared.

11. A game according to claim 1 wherein said entry end is turned upwardly form the axis of said tube.

12. A game according to claim 1 further comprising a funnel-shaped member adapted to be attached to the entry end of said tube.

13. A game according to claim 12 wherein said funnel-shaped member has a flexible spout.

14. A game according to claim 12 wherein said funnel-shaped member has a curved spout.

15. A game according to claim 1 wherein said balls are smooth dense spears of glass or ceramic material.

16. A game according to claim 1 further comprising screen means spanning said walls above and behind home plate.

17. A game according to claim 1 further comprising removable door means closing at least one of said entry ports in said side walls.

18. A game according to claim 1 wherein said offensive player pieces are profiled to the shape of a base runner.

19. A game according to claim 1 wherein said stadium further comprises means limiting batting swings to wrist motion.

20. A game according to claim 19 wherein said means comprises a pair of posts fixed to said member extending normal to said playing surface and spaced equally on opposite sides of and in alignment with home plate.

21. A gameboard on which two opponents can actively participate in simulating the play of a game of baseball, said gameboard comprising:

a rigid member defining a playing surface inscribed with a baseball diamond, said surface being substantially free of any impediment to movement of a ball thereacross;

a plurality of walls joined to each other and to said member about the entire periphery thereof to enclose said playing surface, entry ports in at least two of said walls providing access to opposite sides of home plate, each said entry port providing restricted access to said playing surface; and an opaque, continuous, open-ended tube fixedly mounted on said gameboard aligned with a pitcher's mound and home plate of said diamond and inclined with the lower end fixedly spaced above and between said pitcher's mound and home plate and the upper end fixed to extend above and beyond said wall in centerfield whereby a ball dropped into said tube will roll therethrough exiting to follow a ballistic curve through a strike zone at home plate.

22. A gameboard according to claim 21 wherein said member and said walls define the profile of a baseball stadium.

23. A gameboard according to claim 21 wherein said playing surface has a slight resiliency.

24. A gameboard according to claim 21 wherein said playing surface is curved by a felt-like material colored to depict said baseball diamond.

25. A gameboard according to claim 21 wherein said member and said walls are integral.

26. A gameboard according to claim 21 further comprising means spanning at least a portion of the walls behind home plate whereby protection is provided for pop up balls.

27. A gameboard according to claim 21 further comprising at least one movable wall member adapted to close a respective entry port.

28. A gameboard according to claim 21 further comprising means defining a dugout whereby offensive player pieces can be stored when not in use.

29. A gameboard according to claim 21 further comprising a dice box and dice whereby portions of play which cannot be simulated are determined by the toss of the dice.

30. A gameboard according to claim 21 further comprising a pair of posts fixed to said gameboard extending normal to said playing surface equally spaced on opposite sides of and in alignment with home plate whereby an offensive opponent is limited to wrist action in swinging a bat at a ball delivered through said tube.

31. A gameboard according to claim 21 further comprising scoreboard means attached to an extending above at least one of said walls in a centerfield portion of said gameboard.

32. A gameboard according to claim 31 wherein the higher end of said tube is fixed to an upper edge of said scoreboard.

33. A gameboard according to claim 31 further comprising means providing controlled entry to said tube whereby balls can be entered only by dropping.

* * * * *

UNITED STATES PATENT AND TRADEMARK OFFICE

CERTIFICATE OF CORRECTION

PATENT NO. : 4,735,415

DATED : April 5, 1988

INVENTOR(S) : Ray A. Corn

It is certified that error appears in the above-identified patent and that said Letters Patent is hereby corrected as shown below:

In Column 5, line 45, change "tow-dimensional" to --two-dimensional--.

In Column 8, line 2, change "an" to --and--.

Signed and Sealed this

Twenty-fifth Day of October, 1988

*Attest:*

*Attesting Officer*

DONALD J. QUIGG

*Commissioner of Patents and Trademarks*